US006102774A

United States Patent [19]

Avellanet

[11] Patent Number: 6,102,774

[45] Date of Patent: Aug. 15, 2000

[54] GARMENT HAVING MULTIFILAMENT TWISTED AND DRAWN OR SWAGED SUPPORT ELEMENTS AND ADAPTED TO SUPPORT A FEMALE CHEST

[75] Inventor: Francisco J. Avellanet, Coral Gables, Fla.

[73] Assignee: General Science and Technology Corp., Miami, Fla.

[21] Appl. No.: 09/291,777

[22] Filed: Apr. 14, 1999

[51] Int. Cl.[7] ..... A41C 1/14

[52] U.S. Cl. ..... 450/41

[58] Field of Search ..... 450/41, 42, 43, 450/44, 45, 46, 47, 48, 49, 50, 51, 52, 53; 2/260, 264, 67; 505/231, 431; 428/605, 606, 379

[56] References Cited

U.S. PATENT DOCUMENTS

| | | | |
|---|---|---|---|
| 2,509,353 | 5/1950 | Johnson | 2/42 |
| 2,595,088 | 4/1952 | Light | 2/260 |
| 2,731,640 | 1/1956 | Garson | 450/45 |
| 2,759,190 | 8/1956 | Herbener | 2/42 |
| 2,762,055 | 9/1956 | Bermuller | 2/264 |
| 2,880,732 | 4/1959 | Smith | 128/475 |
| 2,900,981 | 8/1959 | Herbener | 128/465 |
| 2,965,103 | 12/1960 | Blair | 128/466 |
| 3,131,469 | 5/1964 | Glaze | 228/136 |
| 3,140,494 | 7/1964 | Magidson | 450/52 |
| 3,261,908 | 7/1966 | Roche et al. | 174/128 |
| 3,378,999 | 4/1968 | Roberts et al. | 57/139 |
| 3,599,643 | 8/1971 | Schwartz | 450/41 |
| 4,444,192 | 4/1984 | Stern et al. | 128/491 |
| 4,770,650 | 9/1988 | Rowell | 450/52 |
| 5,080,963 | 1/1992 | Tatarchuk | 428/225 |
| 5,118,906 | 6/1992 | Kudoh et al. | 174/130 |
| 5,219,311 | 6/1993 | Fildan | 450/41 |
| 5,483,022 | 1/1996 | Mar | 174/128.1 |
| 5,669,247 | 9/1997 | McCartney et al. | 66/195 |
| 5,697,830 | 12/1997 | White | 450/36 |

*Primary Examiner*—Alissa L. Hoey
*Attorney, Agent, or Firm*—David P. Gordon; David S. Jacobson; Thomas A. Gallagher

[57] ABSTRACT

A garment adapted to support a female chest includes a pair of frontal cup portions of flexible material adapted to cover the chest area of a wearer, each of the cup portions having a perimeter. A multifilament twisted and drawn or swaged cable support element is attached to a portion of the perimeter to provide support for each cup in a manner which is comfortable to the wearer. The multifilament twisted and drawn or swaged cable support element is preferably comprised of a plurality of nickel-titanium wires or a plurality of stainless steel wires, which were formed by first twisting multiple filaments together and then drawing the twisted filaments through multiple dies and/or swaging to form a cable. The multifilament twisted and drawn or swaged cable provides superior support and comfort.

19 Claims, 1 Drawing Sheet

GARMENT HAVING MULTIFILAMENT TWISTED AND DRAWN OR SWAGED SUPPORT ELEMENTS AND ADAPTED TO SUPPORT A FEMALE CHEST

BACKGROUND OF THE INVENTION

1. Field of the Invention

This invention relates broadly to garments such as brassieres and bathing suits. More particularly, this invention relates to brassieres or bathing suits having flexible, yet supportive frame elements. For purposes herein the term "garment" should be considered to include both undergarments and outer garments.

2. State of the Art

The use of metallic wires or frames as stiffening members in the manufacture of brassieres and bathing suits is well known in the art. The wires have a generally U-shaped configuration extending along the side peripheral portions of the brassiere cups and are generally of a rectangular cross-sectional configuration with the longer dimension extending radially with respect to the curvature of the wire. The wires are secured to the garment by enclosing the wires within the fabric along the perimeter of the brassiere cups. The wires may be retained in the fabric by stitching. Typically, the wires or frames are formed of spring steel, and in particular high carbon spring steel.

The use of metallic wires as stiffening members for frames has been found to be suitable insofar as they provide adequate support and definition for the garment. However, since the wire used is a stiff wire, it can cause problems with respect to comfort of the wearer of the brassiere garment. In addition, when the garment is repeatedly washed, shrinkage of the fabric can cause the wires to tear through the stitching or fabric of the brassiere and become a source of discomfort. Several solutions have been proposed. For example, flexible plastic protective tips have been provided over the ends of the wires to prevent the ends of the wire from poking through the fabric. While, the tips may inhibit the ends of the wires from poking through the fabric, the steel wire may still cause discomfort.

U.S. Pat. No. 4,770,650 to Rowell has suggested further treating portions of the steel wires by annealing to create areas of softer wire. It is suggested that the flexible areas may further inhibit the wires from poking through and additionally aid in providing a comfortable brassiere. However, such annealed wires fail to provide a desirable level of comfort for the wearer of a brassiere provided with such wires. In addition, such annealed wires still require plastic tips to prevent the wires from poking through the fabric.

SUMMARY OF THE INVENTION

It is therefore an object of the invention to provide a garment which provides support for a female chest, the garment having cup support members which do not cause discomfort to a wearer of the garment.

It is another object of the invention to provide a brassiere which is comfortable and supportive.

It is a further object of the invention to provide brassieres and bathing suits having cup support members which are relatively flexible, yet provide excellent frame support.

It is also an object of the invention to provide brassieres and bathing suits having cup support members having ends sufficiently flexible such as to not poke through the fabric of the brassiere or bathing suit.

In accord with these objects, which will be discussed in detail below, a garment is provided which includes a pair of frontal cup portions of flexible material adapted to cover the chest area of a wearer, each of the cup portions having a lower edge, an outer edge, and an inner edge, together defining a lower perimeter of the cup portion. In accord with the invention, a multifilament twisted and drawn cable support member is attached to the lower perimeter of each cup portion to provide support for each cup in a manner which is comfortable to the wearer. The multifilament twisted and drawn cable support member is preferably comprised of a plurality of nickel-titanium wires or stainless steel wires, although wires of other metals or alloys, or a combination thereof, may be used. The support member may be coated with a thermoplastic cushioning material. The support member may be preformed with a U-shape, or alternatively, the support member may be secured to each cup portion such that one end of the support member is torqueably twisted relative to the other end. Such a twist enhances the ability of the twisted and drawn cable to provide structural support to each of the cup portions.

Additionally, a front portion of garment is provided with means for connecting inner perimeters of the cup portions together, and a back portion which extends around the back area of the wearer and thereby connects the outer perimeters of the cup portions together. Either the front or back portions of the garment preferably includes means for releasably coupling subportions thereof, thereby facilitating putting on and removing the brassiere. In addition, shoulder strap portions adapted to extend over the shoulder areas of a wearer may be provided to couple the back portion to the cup portions, and provide additional support.

It will be appreciated that the multifilament twisted and drawn cables provide excellent support for the cup portions of the brassiere. In addition, the multifilament twisted and drawn cables are very flexible as formed, without further treatment, and are not prone to poking through the material of the brassiere.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
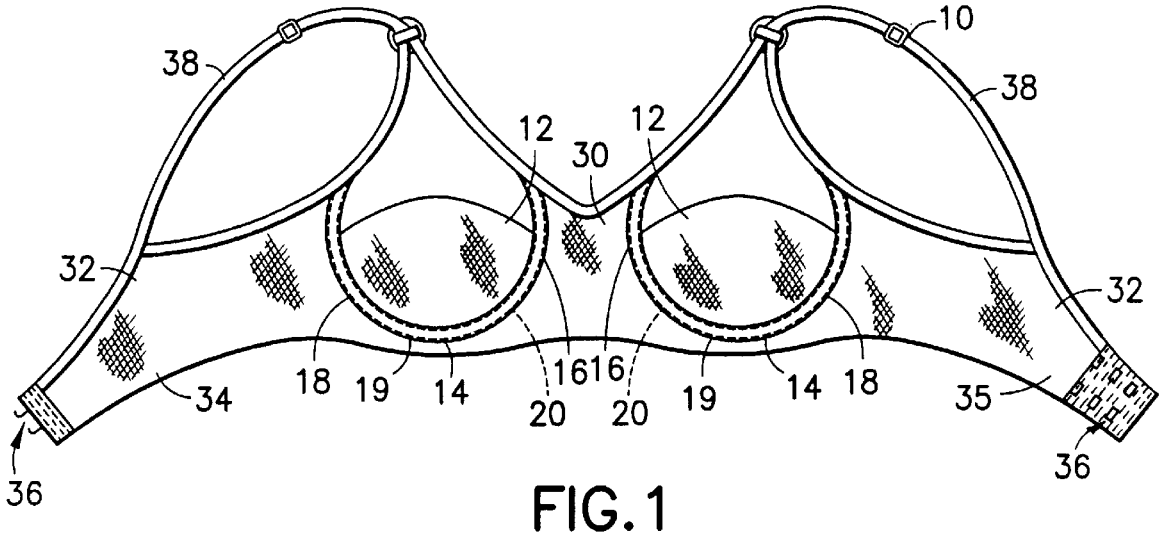
FIG. 1 is a front view of a garment according to the invention.
Figure 2:
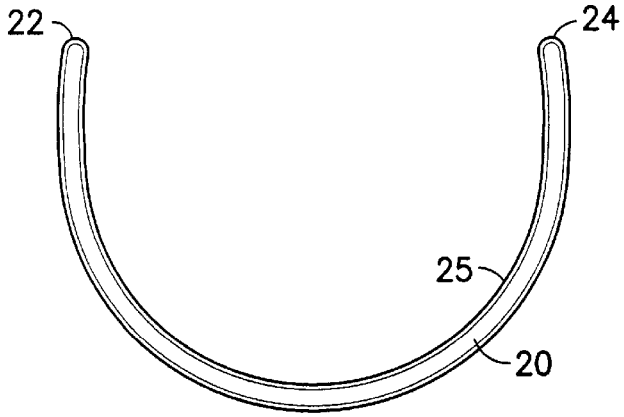
FIG. 2 is a relatively enlarged front view of a support element according to the invention.

Turning now to FIGS. 1 and 2, a garment such as a brassiere according to the invention is shown. The brassiere 10 includes a pair of frontal cup portions 12 made of a flexible material adapted to cover the chest area of a wearer. Each of the cup portions 12 has a perimeter with a lower edge 14, an inner edge 16, and an outer edge 18 which together defining a lower portion 19 of the perimeter of the cup portion. In accord with the invention, a multifilament twisted and drawn or swaged cable support element 20 is sewn at least along a portion of the lower portion 19 of the perimeter (FIG. 2).

The twisted and drawn or swaged cable support element 20 is manufactured according to the following method.

Several filaments, or wires, are twined together to form a wire rope. The wires in the rope are preferably a plurality of nickel-titanium wires or a plurality of stainless steel wires, although wires of other metals or alloys, or a combination thereof, may be used. The wire rope is pulled through a die using known wire drawing methods and apparatus whereby its diameter is decreased. Preferably, the wire rope is successively drawn through dies of decreasing diameter. During the drawing process, the wires are plastically deformed. After the successive drawing is completed, the cable assumes a substantially circular cross section. The cable is then preferably heated to remove cold working.

According to the presently preferred embodiment, the wire rope is successively pulled through four dies of decreasing diameter. The resulting cable has a diameter which is approximately 30–40% smaller than the diameter of the wire rope. Alternatively, the wire rope may be swaged to have a substantially circular cross-section and a reduced diameter. Such multifilament twisted and drawn or swaged cables exhibit relatively high flexibility, torqueability, light weight, and strength. The construction of multifilament twisted and drawn cables is also described in detail in U.S. Ser. Nos. 08/843,405 and 08/856,571, and multifilament twisted and drawn cables comprised at least in part of nickel-titanium alloy are particularly disclosed in U.S. Ser. Nos. 09/044,203, 09/060,969, and 09/087,476, all five applications hereby being incorporated by reference herein in their entireties. A plurality of support elements 20 may then be cut from lengths of the cable. The ends 22, 24 of the support elements 20 are preferably spherically rounded, e.g., by grinding or by plasma discharge welding. The support elements 20 are also preferably coated with a thermoplastic elastomer 25, e.g., by extrusion or heat shrinking. The elastomer provides a cushioning effect.

Prior to coating with the elastomer, the multifilament twisted and drawn cable 20 may be heat-treated, or cold-worked according to methods known in the art to provide the cable with a U-shaped curve to follow the contour of the lower edge 14 of the cup portion 12.

Figure 3:
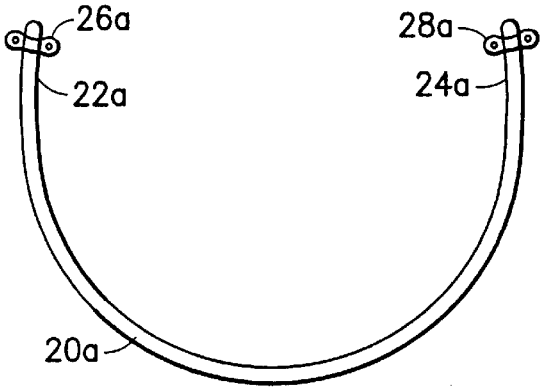
FIG. 3 is a relatively enlarged front view of an alternative support element according to the invention.

Alternatively, and turning now to FIG. 3, the ends 22*a*, 24*a* of the support element 20*a* may be provided with mounting elements 26*a*, 28*a* preferably having loops facilitating sewing attachment of the ends of the cable to the material of the brassiere in a manner which prevents post-attachment twisting of the ends relative to the material. One end 22*a* of the support element 20*a* can be sewn at mounting element 26*a* into the brassiere 10. The support element 20*a* then may be provided with one or more axial twists to impart a torqued U-shaped to the cable, and the other end 24*a* can be sewn at mounting element 28*a* into the brassier such that the ends 22*a*, 24*a* may not rotate about the longitudinal axis of the cable relative to each other, thereby naturally providing the cable with a U-shape. Either alternative provides support to each cup portion in a manner which is comfortable to the wearer.

Referring back to FIG. 1, a front portion 30 of the garment is provided with means (e.g., material and/or coupling means) which connects the inner edges 16 of the cup portions 12 together, and a back portion 32 of the garment is provided with means (e.g., material and/or coupling means) which extends around the back area of the wearer and thereby connects the outer edges 18 of the cup portions together. One or other of the front and back portions 30, 32 is preferably divided into two subportions, e.g., 34, 35, and includes releasable coupling means 36, e.g., opposing hooks and loops, for coupling and uncoupling the subportions 34, 35 to facilitate putting on and removing the garment. In addition, shoulder strap portions 38 adapted to extend over the shoulder areas of a wearer may be provided to couple the back portions to the cup portions, and provide additional support.

It will be appreciated that the multifilament twisted and drawn or swaged cable support elements provide excellent support for the cup portions of the brassiere 10. In addition, the support elements are very flexible as formed, without further treatment, and due to their flexibility are not prone to poking through the material of the brassiere. Moreover, in the embodiment in which the support members are torqued, the support members are biased to hold the lower portions of the perimeters of the cup portions against the chest of the wearer of the brassiere.

There have been described and illustrated herein a garment for supporting a female chest. While particular embodiments of the invention have been described, it is not intended that the invention be limited thereto, as it is intended that the invention be as broad in scope as the art will allow and that the specification be read likewise. Thus, while particular multifilament twisted and drawn or swaged cable support elements have been disclosed, it will be appreciated that other support elements comprising a multifilament twisted and drawn or swaged cable may be used as well. Furthermore, while the support elements have been described as being sewn into to the garment, it will be appreciated that they may be sewn to the external surface of the garment or otherwise coupled or fastened thereto or therein. Moreover, while each cup portion is described as having it own support element, it will be appreciated that a single support member may extend along the lower perimeters of both cup portions or portions thereof. Also, each cup portion may be provided with multiple support elements. In addition, the support elements may be varied in sized according to the size of the cup portion. Furthermore, while shoulder straps have been disclosed, it will be appreciated that a strapless brassiere (i.e., without shoulder straps) may likewise be provided with the support elements described herein. Moreover, while the above description is primarily directed towards a brassiere, it shall be appreciated that the invention is equally applicable to all female chest support garments, and is intended to also be applicable to a chest support component of a two piece bathing suit or the chest support section of a one piece bathing suit. In addition, it will be appreciated that the invention is also applicable to a mastectomy brassiere which may include only a single cup portion. It will therefore be appreciated by those skilled in the art that yet other modifications could be made to the provided invention without deviating from its spirit and scope as so claimed.

What is claimed is:

1. A garment adapted to support a female chest, comprising:

a) a front portion having (i) a pair of flexible front cup portions, each said cup portion having outer edges and a perimeter, (ii) at least one support element attached along a portion of said perimeter of at least one of said cup portions, said at least one support element comprising a a plurality of nickel-titanium wires twisted and drawn or swaged into a cable, and (iii) front means for connecting said cup portions together; and b) a back portion coupling said outer edges of said cup portions together.

2. A garment adapted to support a female chest according to claim 1, wherein:

each said at least one support element is formed with a U-shape.

3. A garment adapted to support a female chest according to claim 1, wherein:

each said at least one support element has two ends, and each end includes a mounting element.

4. A garment adapted to support a female chest according to claim 1, wherein:

each said at least one support element is axially twisted in said garment into a curved shape.

5. A garment adapted to support a female chest according to claim 1, wherein:

each said cup portion includes a lower edge, an outer edge, and an inner edge which together define a lower perimeter, said at least one support element is attached to a said lower perimeter of a said cup portions.

6. A garment adapted to support a female chest according to claim 5, wherein:

each said at least one support element is axially twisted in said garment into a curved shape.

7. A garment adapted to support a female chest according to claim 1, wherein:

said at least one support element is two distinct support elements.

8. A garment adapted to support a female chest according to claim 1, wherein:

each said at least one support element is provided with rounded ends.

9. A garment adapted to support a female chest according to claim 1, wherein:

each said at least one support element is covered in a cushioning material.

10. A garment adapted to support a female chest according to claim 1, wherein:

each said at least one support element is coated in a thermoplastic.

11. A garment adapted to support a female chest according to claim 1, wherein:

at least one of said front and back portions includes two subportions and means for releasably coupling said subportions to facilitate putting on and removing the garment.

12. A garment adapted to support a female chest according to claim 11, wherein:

said means for coupling and uncoupling is at least one hook and at least one loop.

13. A garment adapted to support a female chest according to claim 1, wherein:

said second means for coupling said cup portions comprises shoulder straps.

14. A garment adapted to support a female chest according to claim 1, wherein:

said garment is a brassiere.

15. A garment adapted to support a female chest according to claim 1, wherein:

said garment is a bathing suit.

16. A garment adapted to support a chest of a body of a female wearer, comprising:

a) a front portion having (i) at least one flexible front cup portion having a perimeter, and (ii) at least one support element attached along at least a portion of said perimeter of said at least one cup portion, said at least one support element comprising a a plurality of nickel-titanium wires twisted and drawn or swaged into a cable; and b) means for supporting said front portion on the chest of the body of the wearer.

17. A garment according to claim 16, wherein:

said front portion includes two cup portions.

18. A garment according to claim 17, wherein:

said cup portions each include an outer edge, and said means for supporting includes a back portion connecting said outer edges of said cup portions together.

19. A garment according to claim 16, wherein:

said garment is one of a brassiere and a bathing suit.

* * * * *